United States Patent [19]

Nevins et al.

[11] Patent Number: 4,901,644

[45] Date of Patent: Feb. 20, 1990

[54] LANE MARKER

[75] Inventors: William R. Nevins; Neal M. Lundwall; Dale L. Walker, all of Ridgecrest, Calif.

[73] Assignee: The United States of America as represented by the Secretary of the Navy, Washington, D.C.

[21] Appl. No.: 332,851

[22] Filed: Apr. 3, 1989

[51] Int. Cl.[4] ..... F42B 13/00

[52] U.S. Cl. ..... 102/293; 89/1.13; 102/363

[58] Field of Search ..... 102/293, 302, 363, 401, 102/402, 403; 89/1.13

[56] References Cited

U.S. PATENT DOCUMENTS 3,724,319 4/1973 Zabelka et al. ..... 89/1.13

4,273,048 6/1981 Aley et al. ..... 102/363

4,297,949 11/1981 Glass et al. ..... 102/363

*Primary Examiner*—Charles T. Jordan

*Attorney, Agent, or Firm*—Sol Sheinbein; Melvin J. Sliwka; Harvey A. Gilbert

[57] ABSTRACT

An apparatus for marking safe areas in an explosive hazard environment such as a minefield. The marking apparatus is carried and deposited into a minefield with explosive cloud forming fuel. When the explosive cloud is set off, mines under the cloud are exploded by the overpressure which simultaneously activates a timer securing the apparatus lid. The lid is pushed away by the spring-like, coiled telescoping members which then fully extend beyond the apparatus housing. The tapered ends of each extended telescoping member bear an electroluminescent light stick for nighttime apparatus and location marking, and a member length flag for daytime marking.

16 Claims, 4 Drawing Sheets

LANE MARKER

BACKGROUND OF THE INVENTION

The present invention is an apparatus for marking the postdetonation safe area within an explosive environment. More particularly the present invention provides a means of high visibility marking of a post-detonation safe area within boundaries of an otherwise explosive environment, both during nighttime dark conditions and full-visibility daylight conditions.

The marking of post-detonation safe areas within an explosive hazard environment is usually performed by means of personnel setting marking flags for daylight visibility and placing flares for nighttime visibility to define the safe area. Several problems of note occur when the current methods of marking are used. For one, during nighttime operations, the placement of flares, if done manually, subjects the personnel placing the flares to risk in view of the fact that the maintenance of darkness or a low level of illumination may be operationally desirable and one can not always be certain where unexploded devices are located after the explosions have occurred. Some form of alternative illumination must be carried by the personnel placing the flares in order for them to be able to operate in the nighttime dark environment. Also, during the day a similar but not quite as significant a problem occurs. Specifically, the personnel performing the marking function are still subjected to risk from unexploded and hidden mines even though they have the benefit of daylight. Manually placing flags or flares in an explosive environment, whether at night or in daytime is, without question, a high risk business. Ideally, it is believed that a better and safer way of marking the postdetonation safe areas would be by providing a means for accomplishing the marking that may be introduced to the explosive hazard environment at the same time as the means for detonating a portion of the explosive environment. Obviously, it is imperative that the marking means deployed at the same time as the explosive discharge means be capable of withstanding any explosion used to set off the explosive environment.

One specific type of carrier which may be used to introduce the present invention into an explosive environment which is to be made safe by means of explosive discharge of the environment is what is known as a catapult-launched fuel air explosive weapons system (CATFAE). The CATFAE or similar device is capable of explosively triggering surface and subsurface explosive weapons such as mines in a mine field. The CATFAE is launched in the known direction of a land mine field and causes the mines in its immediate landing area to be detonated. Where a CATFAE device is used without the present invention it is able to explosively discharge an area immediately about its landing site. Further action to mark the cleared zone is required by mine clearing personnel in order to ensure that other personnel and equipment being deployed through the area occupied by the mine field can identify the safe areas cleared by the CATFAE. The CATFAE type of weapon is launched from a safe area and, at a point just prior to impact in the mine field, a parachute is deployed from the CATFAE to cause it to slow and land nose down in the mine field. A fuze on the nose end of the CATFAE device is triggered on impact or shortly thereafter, causing a cloud of explosive fuel to be dispersed in its immediate vicinity. Additionally, detonating devices are deployed into the area underlying the cloud and detonated to cause the explosive discharge of the cloud to be discharged. This explosive discharge produces overpressure in the immediate vicinity which causes mines on the surface and immediately below the surface of the ground beneath the explosive cloud to be set off. As presently used, the CATFAE does not provide a means for marking the safe area created by the explosive discharge of the fuel cloud it releases. Thus, here again, personnel are subjected to hazard when required to enter into the area expected to be explosively discharged and made safe and to mark that area.

It is thus an object of the present invention to provide a means for marking a safe area within an otherwise hazardous explosive environment.

It is yet another object of the present invention to provide a means for marking the area made safe by prior explosive detonation within a surrounding hazardous explosive environment.

It is further an object of the present invention to provide immediate marking of an explosive detonation site within a surrounding explosive hazardous environment.

It is also an object of the present invention to provide a safe area marking capability carried by the means for discharging the immediate explosive environment to create the safe area.

It is yet another object of the present invention to provide a safe area marking capability actuated by means of the explosive mechanism employed to discharge and thus make safe the immediate explosive environment.

It is still another object of the present invention to provide a safe area marking capability deliverable simultaneously and coextensively with the explosive means for safing the deployment site by detonation of the subject explosive environment.

These and other objects of the present invention will be more clearly understood when considered in light of and with reference to the drawings which are hereafter described and the narrative and detailed description which follow.

SUMMARY OF THE INVENTION

The lane marker consists of a cylindrical housing constructed of a shock resistant material which is capable of withstanding the shock and temperature of a discharging explosive environment. The lower portion of the housing contains two sets of three circumferentially sloped cylindrical cavities symmetrically located around and centered upon a circle centered about the longitudinal axis of the housing. The inner set of cylindrical cavities are angled to a greater degree than are the outer circle of cylindrical cavities. Each of the centrally located cavities stores an extensible telescoping member in a spring-loaded fashion. Each of the outer cylindrical cavities contains an elongated capsule light stick one end of which is connected to the top of one of the telescoping members by means of a string tie. A brightly colored flag is also secured at one end by a string tie to the top of each telescoping member and along its length movably by means of three cloth-like loops which encircle the telescoping member. Prior to deployment and activation the flags are stored in the hollow upper compartment within the housing. The light sticks are stored within the outer set of cylindrical cavities within the lower portion of the housing and the extensible telescoping members are compressibly collapsed within the inner sets of cavities. The entire assembly is closed off by a lid secured to the housing by a timer controlled tang extending radially outward from the underside of the lid engaging the lip of an axial retainer located on the outside of the housing. A second axial retainer is located diametrically across from the retainer engaging the tang. A pivoting metal paddle on the top of the lid connects through the lid by means of a pin which extends into a hole in one of the gears in a timer mechanism on the underside of the lid to lock it and restrain it from turning until the lane marker is explosively activated.

DETAILED DESCRIPTION OF THE INVENTION

Figure 2:
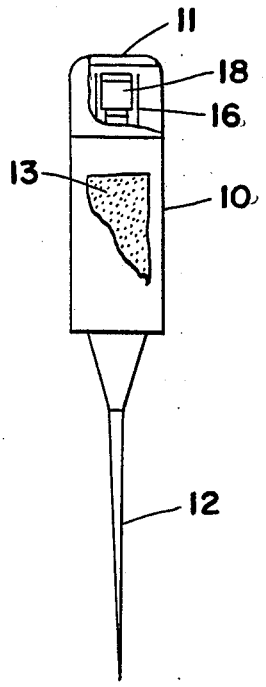
FIG. 2 is a partial cutaway view of the carrier used to deploy the lane marker.
Figure 1:
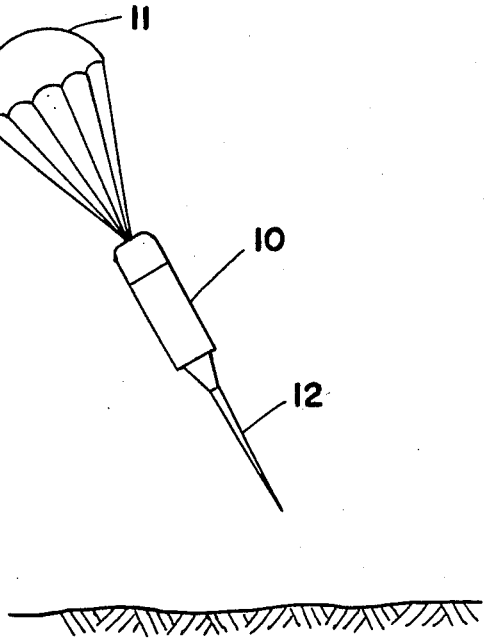
FIG. 1 is a view of the parachute suspended carrier used to deploy the lane marker.

The deployment of the lane marker (18) is shown in FIG. 1 wherein the carrier (10) is depicted in the process of being lowered beneath parachute (11) into an explosive hazard environment such as a mine field. The fuse (12) is shown on the end of the carrier facing the ground. The fuel (13) which is used to create the explosive cloud above the landing area within the explosive environment and the cloud detonators (14) are shown along with the lane marker (18) within the carrier (10) in FIG. 2.

Figure 3:
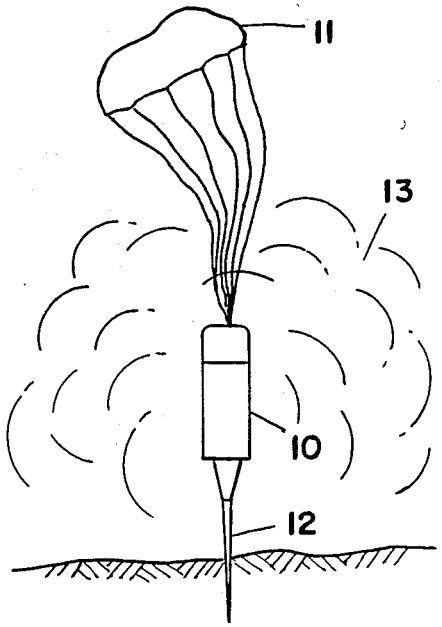
FIG. 3 is a view of the carrier used to deploy the lane marker after impact in an explosive hazard area such as a mine field, and release of its parachute, an explosive fuel cloud and cloud detonators.

In FIG. 3 the fuze (12) is shown in contact with the ground.

Figure 4:
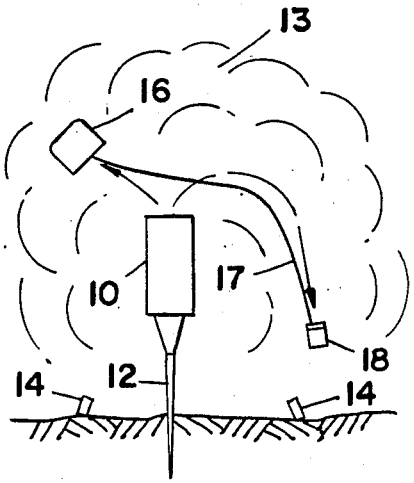
FIG. 4 is a view of the carrier for the lane marker after fuel cloud and cloud detonator deployment and release of the lane marker.

This releases the lane marker (18) which remains secured relative to the carrier (10) by the tether (17) and simultaneously dispenses the fuel cloud detonators (14) as, depicted in FIG. 4. Ten milliseconds after the detonators 14 are released, the carrier (10) bursts and releases the fuel cloud (13) which is ignited by the detonators (14) at a time 210 milliseconds into its formation.

Figure 5:
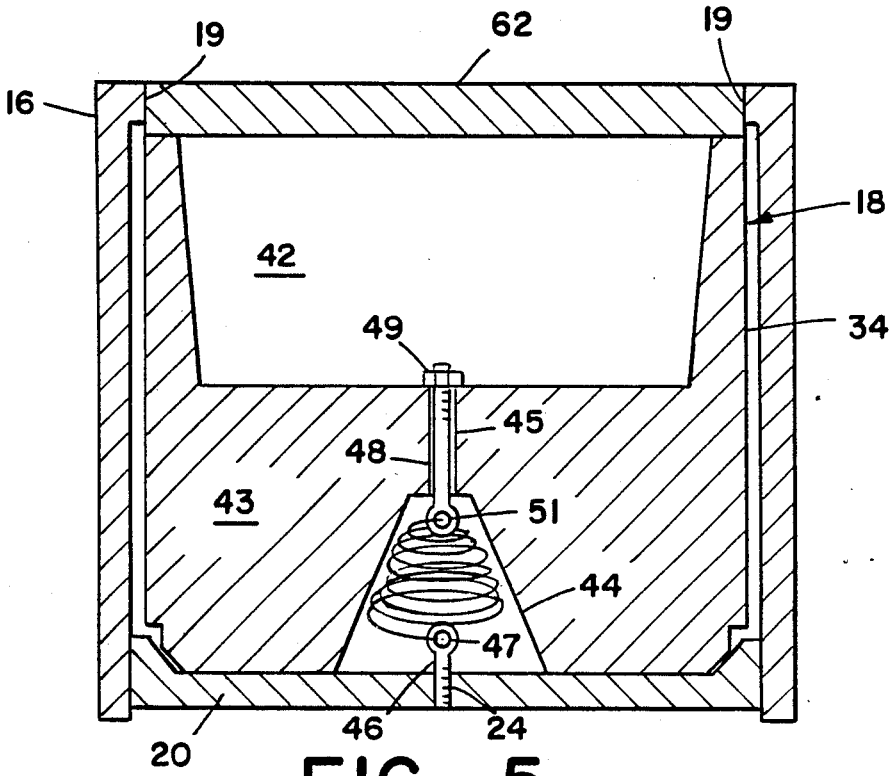
FIG. 5 is a side sectional view of the lane marker within the ejection tube of the carrier.

With reference to FIG. 5, the lane marker (18) is shown within the ejection tube (16). The lip (19) extends around the open end of the ejection tube (!6) to maintain the position of the lane marker (18) when it is within the ejection tube (16). In addition, the lip (19) acts as a stop for the piston (20) shown at the bottom of the ejection tube (16) upon which the bottom of lane marker (18) rests prior to deployment.

Figure 6:
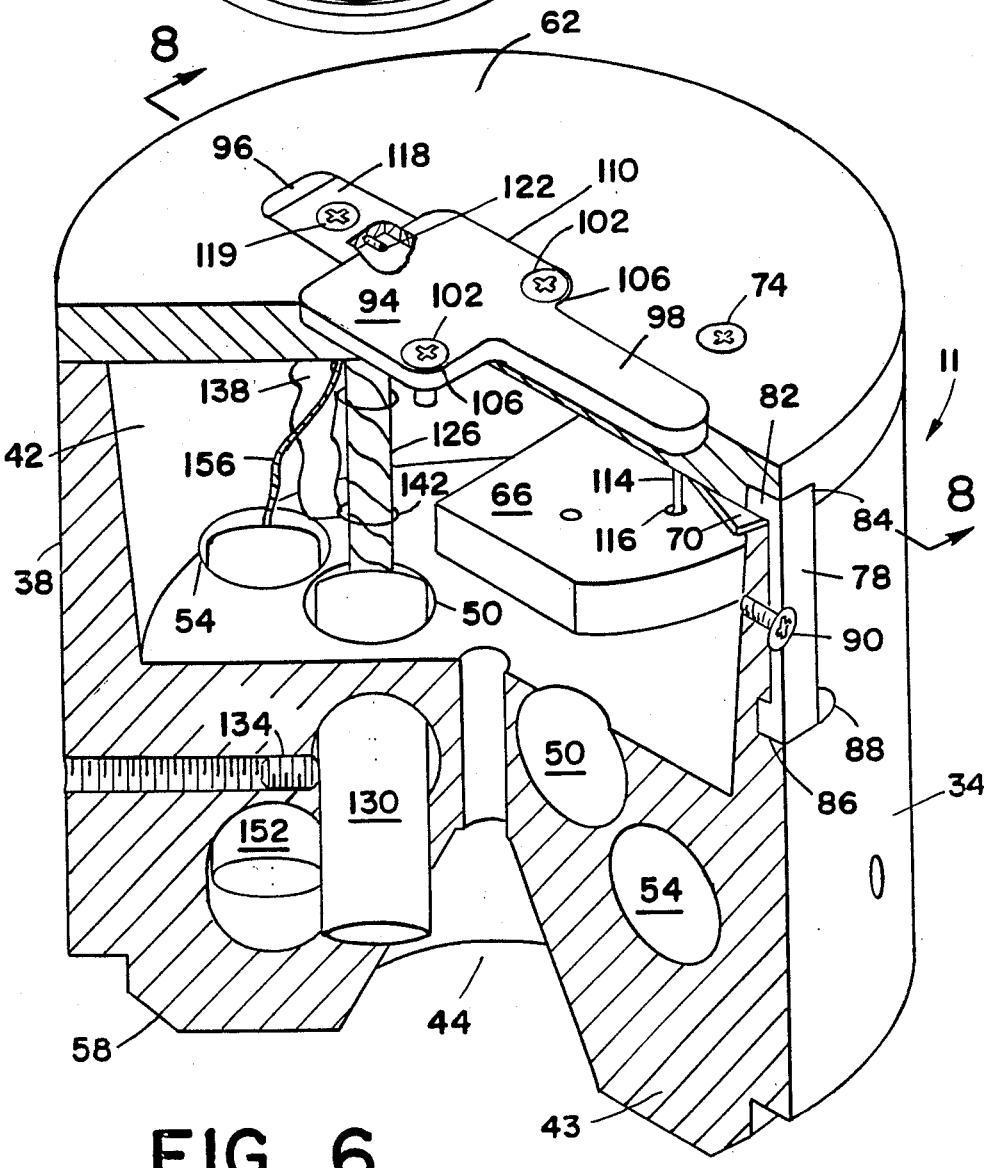
FIG. 6 is a sectional perspective view of the lane marker.

With reference to FIGS. 5 and 6, the lane marker (18) consists of the housing (34) which has an outside wall (38), a hollow upper compartment (42) and a generally solid lower compartment (43). The housing (34) of the preferred embodiment is a temperature and shock resistant nylon capable of use in an explosive environment. The conical chamber (44) extends upward from the flat base of the lane marker (18) through the lower compartment (43) and by way of the hole 45 into the interface between the lower compartment (43) and the upper compartment (42). The hole (45) (See FIG. 5) between the upper compartment (42) and the lower compartment (43) receives the eyebolt (48) which is inserted therein with its threaded end extending into the upper compartment (42) where it is secured by the nut (49), and its opposite end with the eye (51) extending into the conical chamber 44 in the lower compartment (43). A length of nylon tether (17) approximately 44" long is coiled within the conical chamber (44) at the base of the lane marker (18) during the predeployment storage of the lane marker (18) within the carrier (10). One end of the nYlon tether (17) is secured to the eYe (51) of the eYebolt (48). The other end of the nYlon tether (17) is secured to the eye (47) in the eyebolt (46) which is threaded into the mating threaded hole (24) in the piston (20) located beneath the lower compartment (43) of the lane marker (18) within the ejection tube (16).

Figure 7:
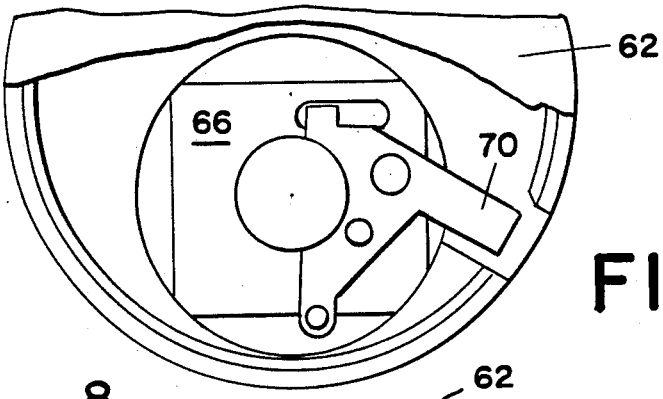
FIG. 7 is a partial top view looking down into the lane marker.

The lower compartment (43) contains a set of symmetrically located inner cavities (50) extending downward from the upper compartment (42) and centered on an inner circle which is itself centered about the central longitudinal axis of the housing (34). A set of outer cavities (54) also extend downward from the upper compartment (42) and are located on a concentric circle within the housing (34) between the circle of inner cavities (50) and the outside wall (38) of the housing (34). The outer cavities (54) are spaced symmetrically about the circle on which they are centered and are located such that each outer cavity opening is centered on a radial line extending from the longitudinal center axis of the housing through the center of an inner cavity opening to the outside wall (38). Both the inner cavities (50) and outer cavities (54) are circumferentially sloped about their respective concentric circles such that the longitudinal axis of each is at an angle to and lies in a plane normal to an intersecting radial plane through the housing (34). Each of the inner cavities (50) is however, oriented at a greater slope then the outer cavities (54). The reason for the difference in slope between the outer cavities (54) and the inner cavities (50) will be discussed below. The base (58) of the housing (34) is shaped to be accommodated within the piston (20). The lid (62) to the upper compartment (42) of the housing (34) has the timer (66) secured to its bottom surface by means of the screws (74) which extend through the top surface of the lid (62). The timer (66) is a spring driven mechanical type in the preferred embodiment. The lid (62) is secured to the lower compartment (43) by means of the tang (70), shown in FIGS. 6 and 7, rotatably connected to and extending from the timer (66) engaging the upper lip (82) of the retainer (78). The upper lip (82) of the retainer (78) fits flush within the recess (84) of the lid (62). The lower lip (86) of each retainer (78) engages the recess (88) within the outside wall (38) of the housing (34). Retainer screws (90) are employed to secure each retainer (78) to the outside wall (38).

Figure 8:
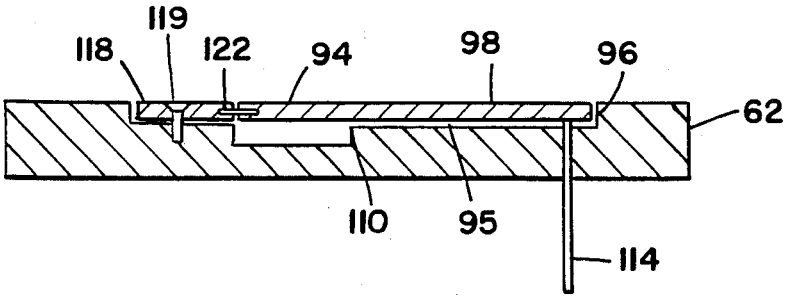
FIG. 8 is a partial side sectional view along line 8—8 of FIG. 6 of the lane marker lid showing the paddle recess.

The paddle (94), fabricated of one-eighth inch sheet aluminum, rests upon a recessed step (95), shown in FIG. 8, within the overall paddle recess (96) on the top surface of the lid (62). The elongated paddle arm (98) is also received within the paddle recess (96). The paddle (94) rests freely upon the recessed step (95) about the edge of the step pivot (110) secured only by the clamping screws (102) which movably retain the paddle (94) by acting as limits upon the machined corners (106) within the paddle recess (96). A timer pin (114) of metal or other rigid material extends downward from the bottom side of the paddle arm (98) through a co-aligned hole in the body of the timer (66) to engage a co-aligned hole in a gear within the timer (66) to keep it inoperative until the lane marker (18) is explosively activated upon deploYment. The recess (96) in the top surface of the lid (62) also accommodates the shear plate (118) on the opposite side of the paddle (94) from the arm (98). The shear plate (118), secured to the lid 62 by the screw 119, contains the shear wire (122) of 0.040 diameter metal which engages a hole in the adjoining side of the paddle (94) to keep the paddle from pivoting until an adequate force created by explosive overpressure is applied to the paddle (94) during the course of operational actuation.

Figure 9:
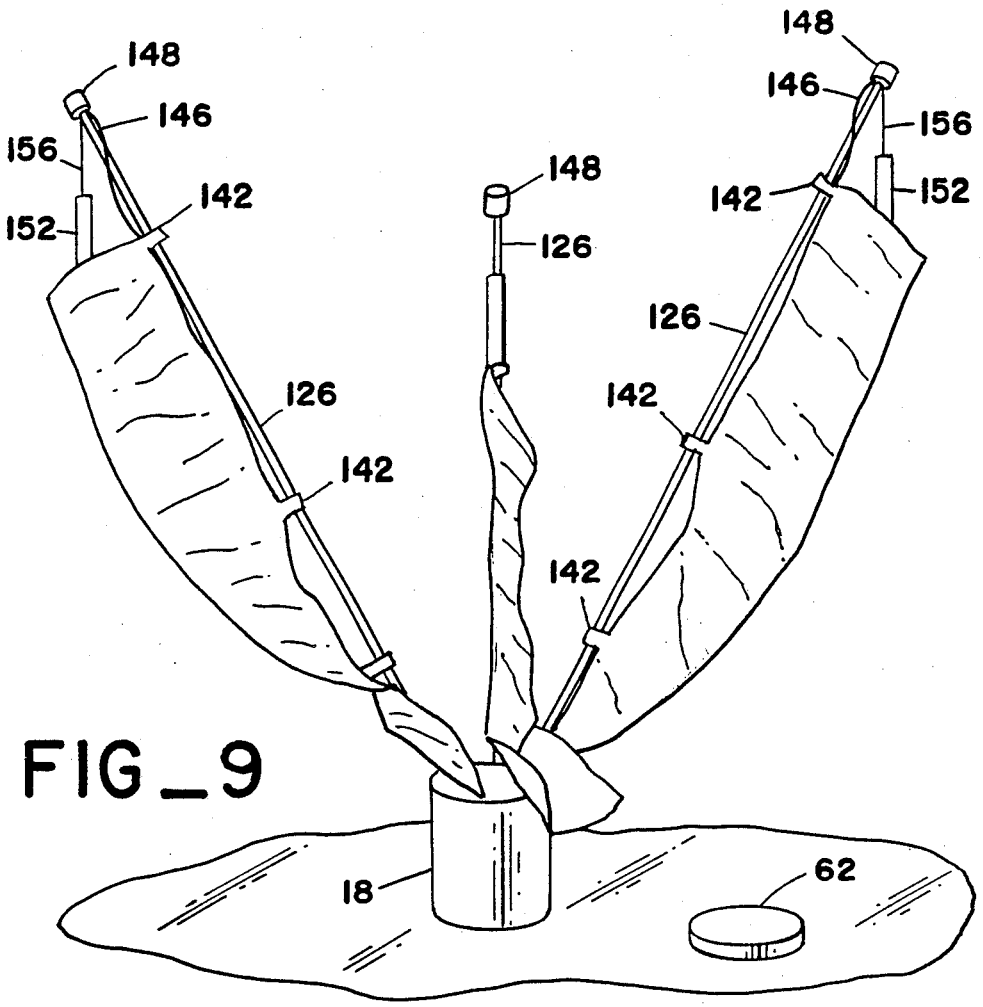
FIG. 9 is a perspective view of the fully deployed lane marker.
Figure 10:
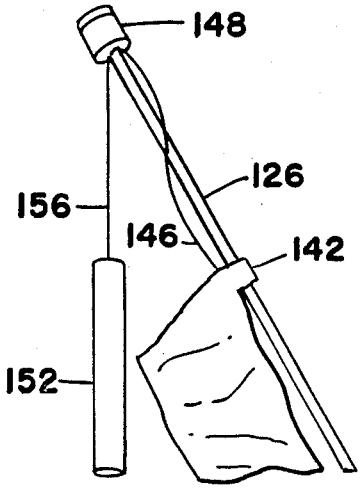
FIG. 10 is a partial perspective view of a telescoping member and light stick.

The helically coiled, spring-like, stainless steel, telescoping members (126) are each secured by the base (130), as seen in FIG. 6, and held by the set screw (134) within each of the inner cavities (50). The flags (138) are secured to the top of each telescoping member (126), as shown in FIG. 9 and 10, by means of the string ties (146) affixed to the end caps (148) and by the loops (142) which are spaced along one long side of each elongated rectangular-shaped flag and about the respective telescoping member (126). The light sticks (152) are likewise secured to the top of each telescoping member (126) by means of the tie (156) affixed to the end caps (148). Each of the light sticks (152) are stored in an outer cavity (54) during predeployment storage. It should be noted that the angle at which the base (130) of each telescoping member (126) is held within each inner cavity (50) is such as to cause each telescoping member (126) to extend at an angle which permits it to pass close to and clear the outside wall (38) of the upper compartment (42) when the lid (62) is removed by the action of the telescoping members extending during deployment actuation. Each of the inner cavities (50) is sloped at an angle of 30° relative to the radial plane normal to the plane in which its longitudinal axis lies or at 60° from the horizontal base (58) of housing (34). This has been found to be most appropriate to permit the desired clearance by the telescoping members (126) of the housing (34) and also to permit at least one telescoping member (126) with attached flag (138) and light stick (152) to be extended upward and thus made visible, if the lane marker (18) lands in a position where the other two telescoping members (126) are in contact with the ground. Each of the outer cavities (54) are sloped at an angle of 10–15° relative to the radial plane normal to the plane in which its longitudinal axis lies or at an angle of 70–85° relative to the horizontal base (58) of the housing (34). This angle makes unimpeded withdrawal of the light sticks (152) possible.

OPERATION

When an explosive hazard environment such as a mine field is to be made safe, a carrier (10), FIG. 1, is used for transporting the means for clearing a safe area within the hazardous area and the lane marker (18) for marking the safe area. The carrier (10), such as a CATFAE round, is launched into the particular area of the hazardous environment to be made safe. A CATFAE-type carrier is lowered by the parachute (11), FIG. 2, near the terminal end of its trajectory. The carrier (10) impacts as shown in FIG. 3 such that the fuse (12) on the end of the carrier (10) opposite the parachute (11) makes the initial contact with the ground, thus triggering and causing the release of the explosive fuel cloud (13), the cloud detonators (14), and, as seen in FIG. 4, the lane marker (18). With reference to FIGS. 4 and 5, release of the fuel (13) for the explosive cloud simultaneously causes the piston (20) to move down the ejection tube (16) until contact with lips (19) in such a way that the lane marker (18) resting thereon is expelled from the ejection tube (16). When the ejection tube (16) is on the ground, the lane marker (18), is connected to it by means of the nylon tether (17) connected to the piston (20) which remains within the ejection tube (16). The travel of the lane marker (18) away from the ejection tube (16) is thus limited to the extent of the length of the nylon tether (17). This length in the preferred embodiment is approximately 24 inches. Prior to expulsion of the lane marker (18) from the ejection tube (16) the nylon tether (17) is stored within the conical chamber (44) in the base of the lower compartment (43) of the lane marker (18). One end of the nylon tether (17) is attached to the eye (47) in the eyebolt (46) extending through the piston (20), and the other end of the nylon tether (17) extends through the eye (51) in the eyebolt (48) which is threadably secured by the nut (49) within the upper compartment (42) of the lane marker (18).

When the fuel cloud detonators (14) explode, the fuel cloud (13) is permitted to be exploded setting off the surface and buried weapons within the explosive environment. The overpressure created by the explosion of the fuel cloud (13) causes the paddle (94) to rotate upon the pivot (110) within the lid (62) so that the shear wire (122) extending between the shear plate (118) and the paddle (94) is severed and the paddle arm (98) is permitted to lift up. When the paddle arm (98) rises up from the lid (62), the timer pin (114) is removed from the hole (116) in the timer (66) and the hole in a gear therein, so that the spring-loaded timer (66) is permitted to start operation. At the appropriate and predetermined time, the tang (70) is caused to be rotated from under the upper lip (82) of the retainer (78) so that the lid (62) is free to be removed from its position closing off the open end of the upper compartment (42). The helically coiled, spring-like telescoping member (126) is held in a compressed state by the lid (62) when it is locked in position in the top of the upper compartment (42) by means of the tang (70) underlying the upper lip (82) of the retainer (78). The lid (62) is pushed off and thrown aside as the telescoping members (126) uncoil and extend upward and outward carrying along the attached flags (138) and light sticks (152). The base (130) of each of the telescoping members (126) is secured within each of the inner cavities (50) in which they are stored by means of the set screws (134) extending through the lower compartment (43) into secure contact which each base (130). The force of the explosive overpressure which initiates removal of the lid (62) simultaneously triggers the chemical reaction within each light stick (152) which results in it becoming illuminated for a predetermined period of time. The length of time that the light stick (152) will remain illuminated depends upon the composition of the ingredients within the light stick (152) and these may be selected for various extended periods of time. The angled position of each of the telescoping members (126) when they have been made operative and extended from within the upper compartment (42) of the housing (34) of lane marker (18) is such that even if the lane marker (18) is resting on its side and not in an upright position, at least one such telescoping member (126) will be positioned above ground level. This assures that at least one flag (138) and one light stick (152) are visible to an observer some distance away from the cleared area within the explosive environment.

The foregoing description provides one embodiment which those skilled in the art will understand can be modified appropriately to satisfy specific use situations without departing from the essence of our invention.

It will be understood by those skilled in the art that many variations of the present invention are possible. For example, a greater number of telescoping members (126) and more than one light stick (152) per telescoping member (126) with different types and configurations of flags may be used. In addition, a variety of mechanical and electronic timers are available for use in the lane marker (18). The many variations of the present invention that are, thus, possible may be made without departing from the scope of the invention as described herein and as claimed herein.

What is claimed is:

1. An apparatus for marking a safe zone in an explosive hazard area comprising:

a housing having a substantially hollow upper compartment and an adjoining and substantially solid lower compartment containing a plurality of cavities opening into said upper compartment;

a lid operatively secured to the upper compartment end of said housing;

a plurality of means extending axially along and beyond the upper compartment end of said housing for securing said lid to said upper compartment;

means affixed to the upper compartment—facing side of said lid for timed actuation of the release of said lid from said upper compartment;

means movably affixed to and communicating through the side of said lid opposite that facing said upper compartment for sensing explosive overpressure and initiating said means for timed actuation of the release of said lid; means connected between said timed actuation means and securing means prior to lid release; and extensible means, disposed compressively within said cavities by said lid until release, for indicating the presence of said apparatus.

2. The apparatus of claim 1 wherein said cavities are arranged symmetrically and centered on the intersection of a plurality of radial lines with an inner and outer concentric circle each of which is centered about the longitudinal axis of said housing.

3. The apparatus of claim 2 wherein said cavities are disposed within said lower compartment at an oblique angle from said longitudinal axis of said housing.

4. The apparatus of claim 3 wherein said cavities are disposed symmetrically about said outer concentric circle and at a less oblique angle than said cavities disposed symmetrically about said inner concentric circle relative to said housing longitudinal axis.

5. The apparatus of claim 4 wherein said lower compartment contains an even number of cavities.

6. The apparatus of claim 5 wherein said cavities are cylindrically shaped.

7. The apparatus of claim 6 where said means for timed actuation, comprises:

a timer, a means connected to said timer for securing its operation until acted upon by said means for sensing and initiating; and means connected to said timer for holding said engaging means in immovable juxtaposition with said securing means until said timer is made operative.

8. The apparatus of claim 7 wherein said means for sensing and initiating comprises;

a flat paddle-shaped plate having an elongated coplanar arm extending from one side of said plate;

a shear wire extending outward from the vertical side of said plate opposite said arm;

a shear plate affixed to said lid in juxtaposition with said vertical side of said plate and having a receptacle for receiving said extending shear wire;

a means affixed to said lid and underlying said paddle for pivoting said paddle about a lateral axis normal to an axis extending longitudinally through said coplanar arm and across said paddle to said shear plate;

means for movably retaining said paddle relative to said pivoting means; and a timer wire affixed to the end of said coplanar arm and extending normal thereto and downward through said lid into obstructive relation with said timer.

9. The apparatus of claim 8 wherein said extensible means for indicating comprises;

a plurality of telescoping members, each having a top and a base, the base of each being secured within a cavity in said lower compartment;

a means for illumination affixed to the top of each of said telescoping members, each said means for illumination sized to be loosely accommodated within a cavity in said lower compartment not otherwise occupied when said lid is in place on said housing prior to explosive activation of said apparatus; and a plurality of flags each having spaced slide loops along one edge and have one extremity of said edge movably affixed to the top of said telescoping member, said slide loops encircling said telescoping member.

10. The apparatus of claim 9 wherein said means for illumination is a chemilluminescent light stick.

11. The apparatus of claim 10 wherein the longitudinal axis of each of said cavities disposed symmetrically about said outer concentric circle is in a plane normal to and at an angle of ten to fifteen degrees (10–15°) relative to a radial plane extending from the longitudinal axis of said housing.

12. The apparatus of claim 11 wherein the longitudinal axis of each of said cavities disposed symmetrically about said inner concentric circle is in a plane normal to and at an angle of thirty degrees (30°) relative to a radial plane extending from the longitudinal axis of said housing.

13. The apparatus of claim 9 wherein said telescoping members are helically coiled.

14. The apparatus of claim 13 wherein said telescoping members are spring-like.

15. An apparatus deliverable by a carrier for marking a safe zone in an explosive hazard area, comprising:

a housing having a substantially hollow upper compartment and an adjoining and substantially solid lower compartment containing a plurality of cavities opening into said upper compartment;

a lid operatively secured to the upper compartment end of said housing;

a pluralty of means extending axially along and beyond the upper compartment end of said housing for securing said lid to said upper compartment;

means affixed to the upper compartment—facing side of said lid for timed actuation of the release of said lid from said upper compartment;

means movably affixed to and communicating through the side of said lid opposite that facing said upper compartment for sensing explosive overpressure and initiating said means for timed actuation of the release of said lid; and, a means for limiting the distance of travel between said apparatus and said carrier when said apparatus is deployed by said carrier.

16. The apparatus of claim 15 wherein said limiting means is a tether.

* * * * *